United States Patent [19]

Khoja et al.

[11] 4,132,349

[45] Jan. 2, 1979

[54] ROTOR DRIVE ASSEMBLY FOR A CENTRIFUGAL LIQUID PROCESSING APPARATUS

[75] Inventors: Mirza A. Khoja, Columbia; Louis F. Gutierrez; John T. Perone, both of Silver Spring, all of Md.

[73] Assignee: Baxter Travenol Laboratories, Inc., Deerfield, Ill.

[21] Appl. No.: 850,621

[22] Filed: Nov. 11, 1977

[51] Int. Cl.[2] ..... B04B 9/08

[52] U.S. Cl. ..... 233/25; 74/722; 74/665 GE

[58] Field of Search ..... 233/23 R, 24, 25, 26; 74/722, 665 GE, 797, 750 R

[56] References Cited

U.S. PATENT DOCUMENTS

| | | | |
|---|---|---|---|
| 2,559,299 | 7/1951 | Helling | 74/797 X |
| 3,115,795 | 12/1963 | Morin | 74/797 |
| 3,986,442 | 10/1976 | Khoja et al. | 74/797 X |

*Primary Examiner*—George H. Krizmanich
*Attorney, Agent, or Firm*—Henry W. Collins; Thomas R. Vigil; Paul C. Flattery

[57] ABSTRACT

The rotor drive assembly is utilized in driving a rotor assembly in an apparatus for centrifugal liquid processing of whole blood wherein whole blood is withdrawn from a donor, passed into a bowl held by the rotor assembly and the blood is centrifuged to separate the same into at least three components within the bowl. One component which is to be collected is withdrawn at a fixed rate of volumetric displacement while the other two components are withdrawn at variable rates of volumetric displacement. The other two components are recombined and returned to the donor. The withdrawal of the one component is optically monitored to determine whether or not either one of the other components is being mixed with the one component. The rotor drive assembly includes a unitary vertical drive shaft having a lower rotatable collar, an intermediate fixed collar and an upper rotatable collar mounted thereon. Two idler pulleys depend from the fixed collar and an idler shaft is rotatably journaled in the fixed collar and has upper and lower pulleys. The lower pulley, the idler pulley and the first collar form planetary drive means driven by a first continuous belt. A second continuous belt engages the upper pulley and the third collar. Also, passage means extend from the center of the upper portion of the drive shaft downwardly and then outwardly through the fixed collar for passing flexible, blood component carrying tubings to the bowl.

1 Claim, 4 Drawing Figures

ROTOR DRIVE ASSEMBLY FOR A CENTRIFUGAL LIQUID PROCESSING APPARATUS

CROSS REFERENCE TO RELATED APPLICATIONS

This application is related to co-pending application Ser. No. 850,622, filed Nov. 11, 1977 and entitled SUPPORT ARM ASSEMBLY FOR A CENTRIFUGAL LIQUID PROCESSING APPARATUS and to co-pending application Ser. No, 850,624, filed Nov. 11, 1977 entitled METHOD AND APPARATUS FOR SEPARATING WHOLE BLOOD INTO ITS COMPONENTS AND FOR AUTOMATICALLY COLLECTING ONE COMPONENT, the disclosures of which are incorporated herein by reference.

BACKGROUND OF THE INVENTION

1. Field of the Invention

The present invention relates to an improved rotor drive assembly for a rotor in a centrifugal liquid processing apparatus for separating whole blood into components thereof and for automatically collecting one of the components.

2. Description of the Prior Art

Heretofore various apparatus have been proposed for separating whole blood into at least three components thereof in a centrifugal liquid processing apparatus where a rotor assembly having a container or bowl for receiving the whole blood to be processed by centrifugation is rotated in the apparatus to cause separation of the whole blood into red blood cells at the outer radius, a buffy coat of white blood cells at an intermediate radius and plasma containing platelets at an inner radius of the container. Outlets are provided on the container at the different radius and tubings are connected to the outlets. Pumps are provided for withdrawing each of the blood components which collects at one of the radii and at a zone adjacent each of the outlets. The outlets are coupled to the tubings either directly or by means of a fluid seal. When they are connected directly, twisting is prevented by reason of the rotor assembly being driven at a speed twice the speed of a coaxial member mounting a cable holding device through which the tubings pass to reach the bowl in the rotor assembly. As a result of the different speeds of the coaxial member and the rotor assembly, twisting is prevented. A further explanation of an apparatus having such an arrangement can be found in U.S. Pat. No. 3,986,442.

In the prior U.S. Pat. No. 3,986,442 there is disclosed a drive mechanism for a centrifugal liquid processing apparatus which includes a lower drive shaft which is driven at the bottom thereof by a prime mover. At the upper end of the lower drive shaft is mounted a rotor drive assembly including a first plate which is journaled to the lower drive shaft. An idler shaft is rotatably journaled in the plate and has a lower pulley. A belt engages the lower pulley and an upper pulley is provided on the idler shaft and two idler pulleys depend from a second plate which is spaced above and fixed to the first plate and rotates therewith. An upper hollow drive shaft is rotatably journaled to the second plate and has a driven pulley at the lower end thereof. A continuous belt engages the upper pulley on the idler shaft, the idler pulleys and the driven pulley at the lower end of the upper drive shaft, all of which together form a planetary drive means.

Containers for centrifuging blood are positioned within a bowl fixed to the upper end of the hollow upper drive shaft. With this arrangement an umbilical cable containing flexible tubings extends through a tubular sleeve mounted to the upper second plate, through the space between the first and second plates and upwardly thrugh the hollow upper drive shaft for connection to the containers in the bowl.

As will be described in greater detail hereinafter, the improved rotor drive assembly of the present invention differs from the rotor drive assembly described above by providing for a unitary vertical drive shaft as opposed to a lower drive shaft and an upper hollow drive shaft and with a different arrangement of pulleys.

SUMMARY OF THE INVENTION

According to the invention, there is provided in a centrifugal liquid processing apparatus a rotor assembly having a container for receiving liquid to be processed by centrifugation which is rotatably mounted on a rotor drive assembly, an improved rotor drive assembly comprising a unitary drive shaft coupled at a lower end thereof to a prime mover, a first collar rotatably journaled to a lower portion of said drive shaft above the lower end thereof, a second collar fixed to an upper portion of said drive shaft above said first collar, a third collar rotatably journaled to said upper portion of said shaft above said second collar, container holding means secured to the upper side of said third collar, first passage means in said upper portion of said drive shaft, second mating passage means in said container holding means, third passage means extending through said second collar from an outer side of said second collar, said first passage means mating at a lower end thereof with said third passage means, two idler pulleys rotatably mounted to parallel spaced stub shafts depending from said second collar, an idler shaft rotatably journaled in said second collar and having a driven pulley at a lower end thereof and a drive pulley at an upper end thereof, said driven pulley, said idler pulleys and said first collar forming planetary drive means driven by a first continuous drive belt engaging the same, and a second continuous drive belt engaging said drive pulley and said third collar whereby said container holding means is driven at a speed which is twice the speed of said drive shaft.

DESCRIPTION OF THE PREFERRED EMBODIMENT

Figure 1:
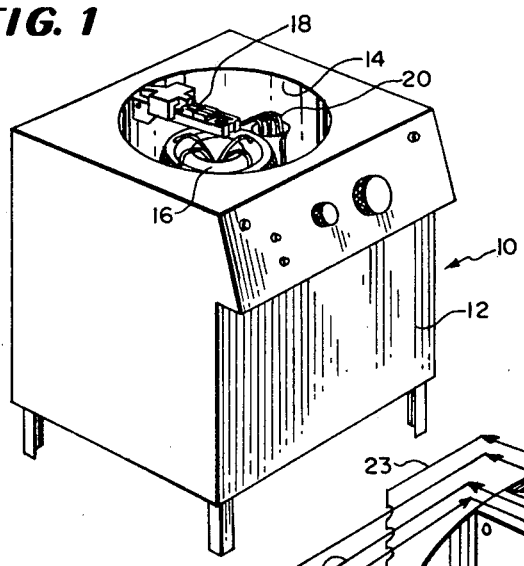
FIG. 1 is a perspective view of a centrifugal liquid processing apparatus utilizing the improved rotor drive assembly of the present invention.

Referring to the drawings in greater detail there is generally illustrated in FIG. 1 a centrifugal liquid processing apparatus 10 for separating whole blood into components thereof. The apparatus 10 includes a cabinet 12 having a generally cylindrical opening 14 in the top thereof in which is situated a centrifuge device 16. Extending from an inner wall of the cylindrical opening 14 is a support arm assembly 18, the outer end of which is located over and centrally of the centrifuge device 16. A group 20 of four flexible tubings extend through the outer end of the arm assembly 18 for connection to the centrifuge device 16.

Figure 2:
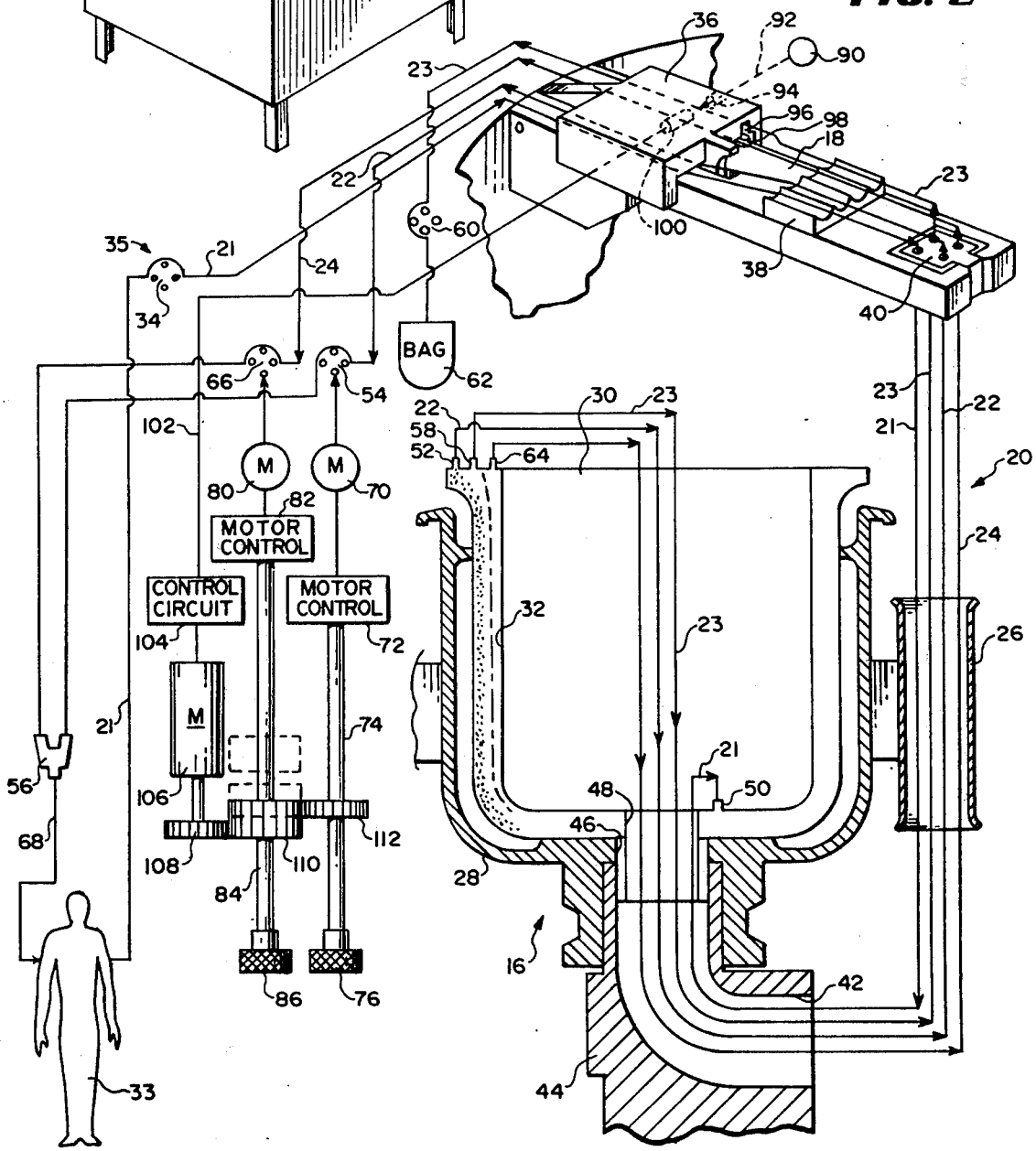
FIG. 2 is a schematic diagram of the fluid system of the apparatus shown in FIG. 1 and of the electromechanical control system for the apparatus including fragmentary portions of the apparatus.

As best shown in FIG. 2, the group 20 of the tubings comprises four tubings 21, 22, 23 and 24 which extend from the arm assembly 18 through a tubular sleeve 26 mounted to the side of a container holding receptacle 28 of the centrifuge device 16. Mounted in the centrifuge device 16 is a closed bowl 20 having a hollow interior 32 in which whole blood is centrifuged as will be described hereinafter in greater detail.

Referring to FIG. 2, the first tubing 21 is coupled in a conventional manner to a donor 33 and passed over and forms part of a peristaltic pump 34 which is operable to withdraw whole blood from the donor 33. Although not shown, it will be understood that suitable low and high pressure sensors are provided in the tubing 21 to sense high and low pressure conditions indicating a leak in the fluid system of the apparatus 10, which system is generally identified by reference numeral 35, or an occluded vein in the donor 33. When such a condition is sensed, the low and/or high pressure sensors are then operative to stop operation of the apparatus 10.

After leaving the peristaltic pump 34, the tubing 21 is directed into the apparatus 10 and onto the arm assembly 18 beneath a latch member 36 which is part of and which holds the arm assembly 18 in place and at the same time holds the tubings 21–23 on the arm assembly 18. From there the tubing 21 is trained over a tubing guide member 38 mounted on the arm assembly 18 and then through an aperture in a tubing holder 40 located at the outer end of the arm assembly 18. Then the tubing 21 passes through the tubular sleeve 26 and into a passageway 42 formed in a drive shaft 44 of a rotor drive assembly for the centrifuge device 16.

As shown, the passageway 42 is L-shaped and extends from a side of drive shaft 44 radially inwardly and axially upwardly of the drive shaft 44 and into mating engagement with an opening 46 in the container holding receptacle 28 and through a mating opening 48 into the bottom of the bowl 30 where it connects to an inlet 50 to the hollow interior 32 of the bowl 30.

Within the bowl 30 red blood from the donor is centrifuged upon rotation of the bowl 30 with red blood cells collecting at an outer radius, a buffy coat of white blood cells collecting at an intermediate radius, and plasma with platelets therein collecting at an inner radius within the hollow portion 32 of the bowl 30. An outlet 52 is provided on the upper rim of the bowl 30 at the outer radius and adjacent a zone where the red blood cells collect. The second tubing 22 is connected to this outlet 52 and extends therefrom through the passages 48 and 42, the sleeve 26, the apertured holder 40, over guide member 38 under the latch member 36 and then over and forming a part of a peristaltic pump 54 and from there to a Y-coupling 56.

In like manner the third tubing 23 is connected to an outlet 58 on the upper rim of the bowl 30 at the intermediate radius and adjacent a zone where a buffy coat of white blood cells collects in the hollow interior 32 of the bowl 30. The tubing 23 then passes through the passages 48 and 42 through the sleeve 26, the apertured holder 40, over guide member 38 and underneath the latch member 36 and then over and forming part of a peristaltic pump 60 to a white blood cell collection bag or receptacle 62.

Again, in like manner, the fourth tubing 24 is connected to an outlet 64 located on the upper rim of the bowl 30 at an inner radius where plasma collects. From there the tubing 24 extends through the passages 48 and 42, the sleeve 26, the apertured holder 40, over the guide member 38, under the latch member 36 and then over and forming part of a peristaltic pump 66 from which the tubing 24 extends to the Y-coupling 56 where plasma and red blood cells are recombined and returned via a tubing 68 to the donor 33.

As shown, the peristaltic pump 54 is driven by a motor 70, the speed of which is controlled by a motor control 72 which is operated by a rotatable control rod 74 having a knob 76 on the outer end thereof for manual operation of the motor control 72. Typically, the motor control 72 will include an adjustable potentiometer which has a rotating sweep arm that is rotatably coupled to the rod 74 such that rotation of the knob 76 will cause adjustment of the potentiometer thereby to cause the motor control 72 to change the speed of the motor 70 for changing the speed of the pump 54.

Likewise, the peristaltic pump 66 is driven by a motor 80, the speed of which is controlled by a motor control 82 having a rod 84 extending therefrom. The rod 84 also has a knob 86 at the outer end thereof. In a similar manner to the motor control 72, the motor control 82 has a potentiometer with a rotating sweep arm which is rotatably coupled to the rod 84 such that rotation of the knob 86 will adjust the setting of the potentiometer to cause the motor control 82 to change the speed of the motor 80 and thereby the speed of the pump 66.

A light source 90 and a light (fiber optic) pipe 92 transmit light from the light source 90 to a passageway 94 in the latch member 36. The passageway 94 opens into a groove 96 in the latch member 36, which groove is aligned with a boss 98 mounted on the arm assembly 18. The boss 98 holds the light transmissive portion of the tubing 23 in the groove 96 so that light entering the passageway 94 is passed through the light transmissive portion of the tubing 23 to a light pickup device 100 in an aligned passageway 101 in the latch member 36 so that the optical density of the white blood cells being withdrawn through the tubing 23 can be sensed and monitored by light pickup device 100.

The light pickup device 100 can be a fiber optic pipe or can be a sensor with an electrical conductor leading therefrom. In either event there is illustrated in FIG. 2 a line 102 from the light pickup device 100 which can be a continuance of the device 100, namely, a fiber optic light pipe or which can be an electrical conductor, either of which is connected to a control circuit 104. As will be described in greater detail hereinafter, the control circuit 104 is operable to drive a gear drive motor 106 which is connected to a gear 108. The gear 108 is adapted to mesh with a gear 110 on the rod 84 which in turn meshes with a gear 112 on the rod 76 as shown in FIG. 2.

The control circuit 104 determines whether or not the light (optical density) received by the light pickup device 100 is within a predetermined range and whether or not the optical density is increasing or decreasing. Then, depending upon the optical density sensed and whether it is increasing or decreasing the control circuit 104 will cause various rotations of the motor 106 and gear 108, thereby to cause the gear 110 to rotate in a clockwise or counterclockwise direction which in turn will cause the gear 112 to rotate in a counterclockwise or clockwise direction. Such rotations of the gears 110 and 112 will cause an adjustment of the potentiometers in the motor control circuits 82 and 72 to effect corresponding changes, but in opposite directions, in the speeds of the motors 70 and 80. In this respect, when the speed of motor 80 is increased or decreased, the speed of the motor 70 is decreased or increased.

Briefly, summarizing the operation of the electromechanical system of the apparatus 10, which system is generally identified by reference numeral 113, when the density of the buffy coat of white blood cells being withdrawn darkens beyond a predetermined range, defining a desired composition of the buffy coat being withdrawn, the control circuit 104 will cause the speed of motor 70 to be increased and the speed of motor 80 to be decreased so that more red blood cells and less plasma are withdrawn from the bowl 30. In this way the zone containing the desired composition of a buffy coat of white blood cells is maintained at the radius of the outlet 58.

In like manner when the optical density of the buffy coat sensed is below the predetermined range indicating that more plasma is in the buffy coat than is desired, the control circuit 104 will cause the motor 106 to rotate the gear 108 so as to cause the motor control 82 to increase the speed of the motor 80 and the motor control 72 to decrease the speed of the motor 70 thereby to withdraw more plasma and less red blood cells and maintain the zone of the buffy coat having the desired composition of white blood cells at the radius of the outlet 58.

To provide greater flexibility in the apparatus 10 the rod 84 is axially movable between three positions, the first position being that shown solid in FIG. 2 where the gear 110 engages the gear 108 and the gear 112. In a second position, the rod 84 is moved inwardly toward the motor control 82 to a position where the gear 100 shown in phantom lines does not engage the gear 108 but only the gear 112. In this position, only manual adjustment of the speeds of the pumps 54 and 66 can be effected and in this position adjustment of one knob 86 causes an equal adjustment but in the opposite direction of the other knob 76.

In the third position, the gear 110, again shown in phantom lines, does not engage either of the gears 108 or 112. In this position, the speed of the pumps 54 and 66 and the respective rates of withdrawal of fluids through the tubings 22 and 24 are each controlled separately by the knobs 86 and 76.

Figure 3:
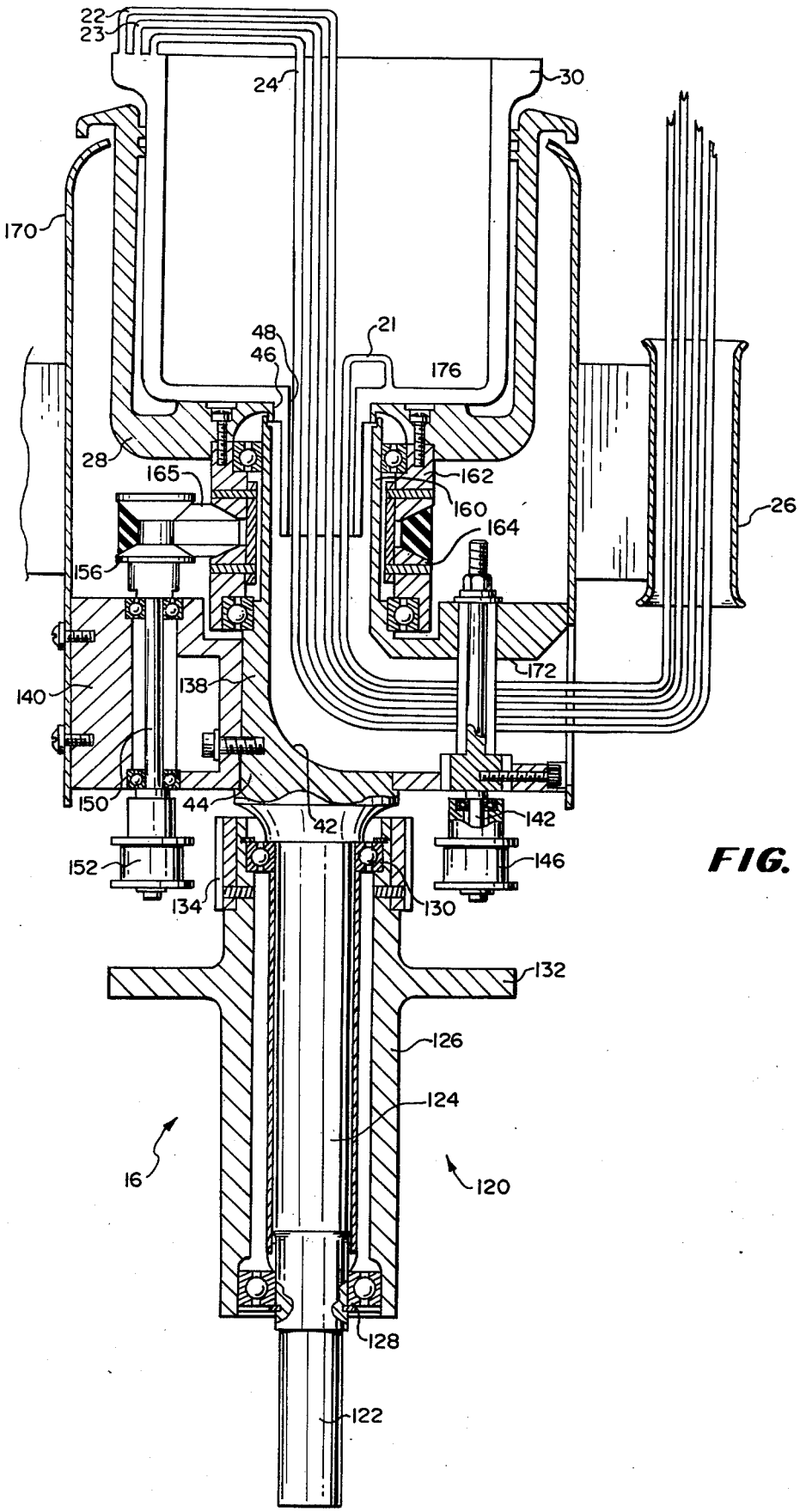
FIG. 3 is a vertical sectional view of the rotor drive assembly of the present invention.
Figure 4:
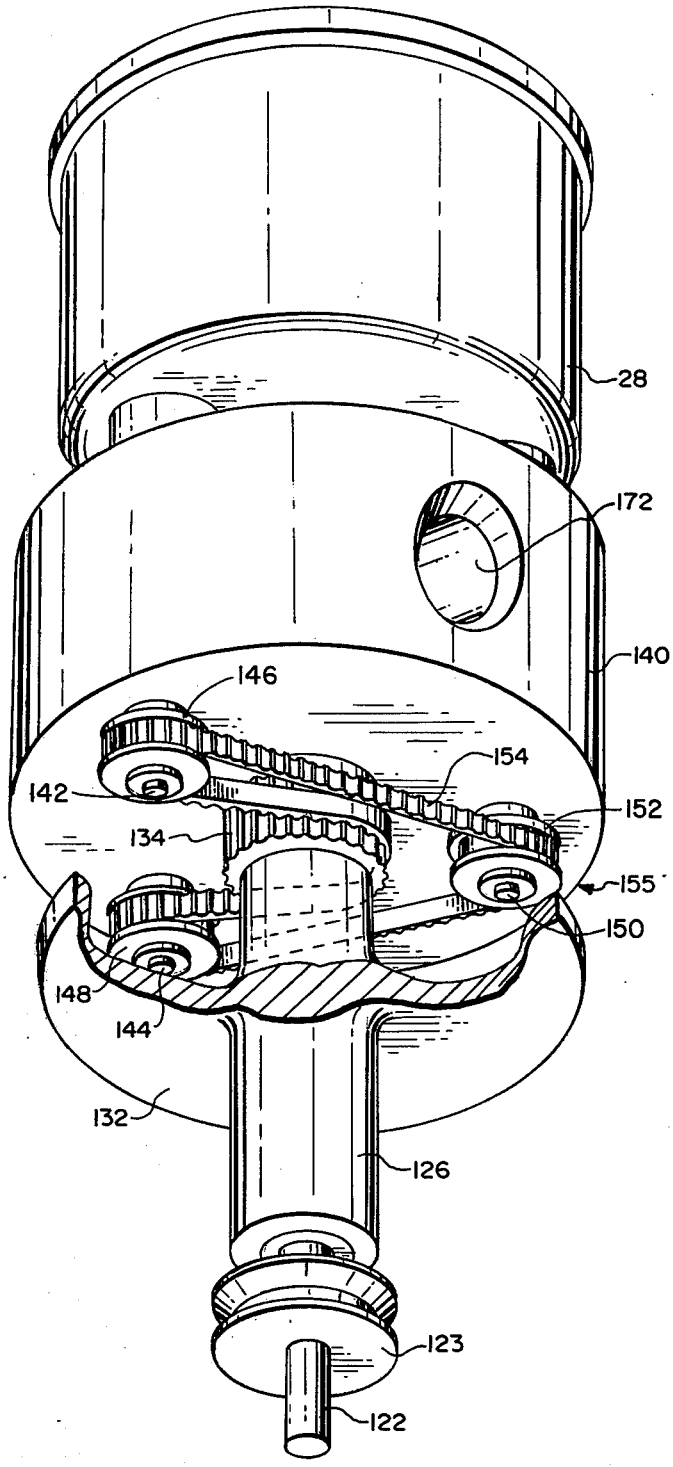
FIG. 4 is a vertical perspective view of the rotor drive assembly viewing same from a lower side thereof.

In accordance with the teachings of the present invention, the centrifuge device 16 includes a rotor drive assembly 120 which utilizes unitary vertical drive shaft, a portion of which is shown and identified by reference numeral 44 in FIG. 2 and which is more fully illustrated in FIG. 3. As shown, the drive shaft 44 has a lower end 122 which is adapted to be coupled by means of a pulley 123 (FIG. 4) to and driven by a prime mover not shown. A lower portion 124 above the lower end 122 of the drive shaft 44 has a first collar 126 rotatably journaled thereon by means of bearings 128 and 130. As shown, the collar 126 has an annular flange 132 forming a partial shield for a planetary gear arrangement to be described hereinafter and which is located above the flange 132. The upper end of the collar 126 has a pulley 134 thereon.

An upper portion 138 of the drive shaft 44 has a second annular collar 140 fixed thereto. As shown, the annular collar 140 has an outer diameter greater than the diameter of the lower rotatable collar 126. Depending from the second collar 140 are two stub shafts 142 and 144 (FIG. 4) which mount idler pulleys 146 and 148.

Also, an idler shaft 150 is rotatably journaled in the fixed collar 140 and has a lower driven pulley 152 which together with the idler pulleys 146 and 148 and the pulley 134 on the collar 126 together form, with a continuous belt 154 (FIG. 4) engaging all these pulleys, a planetary drive arrangement 155.

An upper drive pulley 156 is fixed to the upper end of the idler shaft 150. At an upper end 160 of the upper portion 138 is rotatably journaled a third upper collar 162. Secured to the upper rotatable collar 162 is the container holding receptacle 28.

A pulley 164 is formed on or secured to the upper collar 162 in alignment with the drive pulley 156. It will be understood that a continuous belt engages the pulleys 156 and 164 and is designated by the reference number 165.

As shown, a shell 170 is secured to the intermediate fixed collar 140 and extends upwardly to shield the lower end of the container holding receptacle 28 and the pulleys 156 and 164. Also, the tubular sleeve 26 is fixed to the shell 170.

To provide a path for the tubings 21–24 to extend from the bottom of the sleeve 26 into the bowl 30, the fixed collar 140 has a radial passage 172 therethrough which mates with the lower end of the passage 42 in the upper portion 138 of the drive shaft 44. As described above, the passageway 42 is L-shaped and extends upwardly axially of the drive shaft 44 through the upper end 160 of the drive shaft 44 and mates with the opening 46 in the container holding receptacle 28 and the opening 48 in the lower end of the bowl 30. Actually, and as shown in FIG. 3, the bowl 30 has a lower depending hollow stem 176 at the center thereof which extends through the opening 48 in the container holding receptacle 28. With this arrangement, the tubings 21–24 are passed through the sleeve 26 and passages 172, 42 and 48 into the center of the bowl 30 and connected as shown.

With the mounting arrangement of the pulleys described above, the drive shaft 44 and the tubular sleeve 26 holding the tubings 21–24 are rotated at one speed while the bowl 30 received therein are rotated at twice that speed. With this speed ration of 2 to 1, twisting of the tubings 21–24 is prevented.

From the foregoing description, it will be apparent that the improved rotor drive assembly 120 of the present invention provides a number of advantages, some of which have been described above and others of which are inherent in the invention. More specifically, the rotor drive assembly 120 provides for a unitary drive shaft which minimizes problems of alignment and provides for a more balanced and stable rotation of the centrifuge device 16.

Also, it will be apparent that obvious modifications and variations can be made to the rotor drive assembly 120 of the present invention without departing from the teachings of the invention. Accordingly, the scope of the invention is only to be limited as necessitated by the accompanying claims.

We claim:

1. In a centrifugal liquid processing apparatus wherein a rotor assembly having a container for receiving liquid to be processed by centrifugation is rotatably mounted on a rotor drive assembly, the improvement residing in said rotor drive assembly comprising a unitary drive shaft coupled at a lower end thereof to a prime mover, a first collar rotatably journaled to a lower portion of said drive shaft above the lower end thereof, a second collar fixed to an upper portion of said drive shaft above said first collar, a third collar rotatably journaled to said upper portion of said drive shaft above said second collar, container holding means secured to the upper side of said third collar, first passage means in said upper portion of said drive shaft, second mating passage means in said container holding means, third passage means extending through said second collar from an outer side of said second collar, said first passage means mating at a lower end thereof with said third passage means, two idler pulleys rotatably mounted to parallel spaced stub shafts depending from said second collar, an idler shaft rotatably journaled in said second collar and having a driven pulley at a lower end thereof and a drive pulley at an upper end thereof, said driven pulley, said idler pulleys and said first collar forming planetary drive means driven by a first continuous drive belt engaging the same, and a second continuous drive belt engaging said drive pulley and said third collar whereby said container holding means is driven at a speed which is twice the speed of said drive shaft.

* * * * *

UNITED STATES PATENT AND TRADEMARK OFFICE

CERTIFICATE OF CORRECTION

PATENT NO. : 4,132,349

DATED : January 2, 1979

INVENTOR(S) : Mirza A. Khoja et al.

It is certified that error appears in the above–identified patent and that said Letters Patent are hereby corrected as shown below:

On the Cover Sheet Section 75, "Louis F. Gutierrez" should read -- Luis F. Gutierrez --.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*